US005975662A

United States Patent [19]

Weber

[11] Patent Number: 5,975,662

[45] Date of Patent: Nov. 2, 1999

[54] OPENING AND CLOSING MECHANISM FOR A DRAWER OF A FURNITURE ELEMENT

[75] Inventor: Peter Weber, Beinwill am See, Switzerland

[73] Assignee: Peka-Metall AG, Switzerland

[21] Appl. No.: 09/069,305

[22] Filed: Apr. 29, 1998

[30] Foreign Application Priority Data

May 1, 1997 [CH] Switzerland ..... 1020/97

[51] Int. Cl.[6] ..... A47B 95/02

[52] U.S. Cl. ..... 312/319.9; 312/319.1; 312/333; 292/251.5

[58] Field of Search ..... 312/319.9, 319.1, 312/333, 222, 139; 292/251.5, DIG. 12

[56] References Cited

U.S. PATENT DOCUMENTS

| | | | |
|---|---|---|---|
| 2,735,740 | 5/1976 | Soans . | |
| 3,239,298 | 3/1966 | McCarthy | 312/333 |
| 3,364,621 | 1/1968 | Erickson | 312/319.9 X |
| 3,854,785 | 12/1974 | Manner et al. | 312/319.1 |
| 3,980,326 | 9/1976 | Smith . | |
| 4,023,875 | 5/1977 | Difley et al. | 312/319.1 |
| 4,155,610 | 5/1979 | Englund . | |
| 4,182,539 | 1/1980 | Busch | 312/333 |
| 4,460,222 | 7/1984 | Larking | 312/222 X |
| 4,911,508 | 3/1990 | Tillman | 312/319.9 |
| 5,386,636 | 2/1995 | Asano | 312/333 X |
| 5,518,282 | 5/1996 | Sawada . | |
| 5,622,416 | 4/1997 | Rainey et al. | 312/319.9 |
| 5,718,495 | 2/1998 | Lee | 312/319.1 |
| 5,836,049 | 11/1998 | Chiang | 292/251.5 X |

FOREIGN PATENT DOCUMENTS

| | | | |
|---|---|---|---|
| 662601 | 5/1963 | Canada | 312/319.9 |

*Primary Examiner*—Peter M. Cuomo
*Assistant Examiner*—Hanh V. Tran
*Attorney, Agent, or Firm*—Zarley, McKee, Thomte, Voorhees & Sease

[57] ABSTRACT

A drawer can be pulled out of, and pushed into, a furniture element along guides. Disposed on the furniture element are magnets on which a ferromagnetic plate, disposed on the drawer, abuts and is firmly held in the pushed-in state of the drawer. Disposed on the furniture element is a lever which is pivotable about a pivot axis and which can be foot-operated. By means of said lever, the plate can be released from the magnet, and the drawer brought into the pulled-out position by means of a spring element. The lever comprises a bow connected to the element forming the pivot axis. Said element is held in bearing elements fastened to two angle pieces and. These angle pieces each have an arm which is fastened lying flat on the floor of the furniture element. The other arm in each case lies flat against the front face of the floor of the furniture element, and projects over the floor on the underside, where the bearing elements are disposed. The opening and closing mechanism can be positioned in the respective furniture element most easily during assembly. In addition, the lever can be designed to be very wide, whereby actuation is facilitated.

9 Claims, 3 Drawing Sheets

OPENING AND CLOSING MECHANISM FOR A DRAWER OF A FURNITURE ELEMENT

BACKGROUND OF THE INVENTION

This invention relates to an opening and closing mechanism for a drawer, which, along guides, can be pulled out of, and pushed into, a furniture element formed by a floor, side walls and a cover.

Devices of this kind are used especially in kitchen drawers, these drawers being provided with a system for garbage, i.e. there being various receptacles provided in the drawer to receive sorted refuse.

Opening and closing mechanisms of this kind are known. For example, on the market is an opening and closing mechanism consisting of a plate-shaped foot pedal, made of plastic, which is pivotable about a swivel pin held in a crosspiece provided with two tabs. This crosspiece must be screwed from below onto the floor of the furniture element. The magnets are set in the foot pedal in the area of the swivel pin. When fastening the crosspiece on the underside of the floor of the furniture element, it must be seen to it that the contact surface of the magnets is flush with the front face of the floor of the furniture element. The plate, made of iron, then has to be screwed onto the front cover of the drawer, whereby it must also be seen to it that, in the closed state of the drawer, this plate covers over the magnets mounted on the foot pedal.

Thus the design just described has in particular the drawback that a precise placement must be sought during assembly of this device since such a placement is not ensured by means of limit stops or the like.

Moreover it is also disadvantageous that the installation described has a minimal width so that the pedal to actuate the opening mechanism cannot be immediately found with one's foot since the pedal is not visible from above as it is concealed by the front cover.

In addition, this plate-shaped foot pedal of plastic in no way fulfill high demands with respect to aesthetic appearance.

The object of the present invention therefore is to create an opening and closing mechanism for a drawer of a furniture element, which is easy to assemble since appropriate reference points are provided to indicate the precise positioning.

SUMMARY OF THE INVENTION

This object is fulfilled according to the invention with an opening and closing mechanism comprising:

- a holding device, which consists of at least one angle piece having two arms, which device is fixed to said floor in such a way that one of two said arms lies flat against said floor of said furniture element, and the other of said two arms abuts the front face of said floor and has a portion projecting underneath from said floor;
- at least one bearing element provided on said other of said two arms, on the portion projecting from the floor;
- at least one holding element provided on said holding device, in which holding element at least one magnet can be inserted;
- a ferromagnetic plate, which is mounted on the drawer and which abuts the magnet in the state where the drawer is pushed into the furniture element;
- a pivotable lever, held in at least one bearing element so as to be pivotable about a pivot axis, and foot-operable, by means of which lever the plate can be released from the magnet; and
- a spring element which brings the drawer into the pulled-out position in the state where the magnet has been released from the plate.

Moreover the foot-operated lever should be designed in such a way that aesthetic demands are fulfilled.

By designing the mounting to receive the swivel pin and the magnets as an angle piece, the advantage is gained that the surfaces of this angle piece serve at the same time as stop faces for the precise positioning of this mounting during assembly of the furniture element.

The foot-operated lever and the pivot axis each consist preferably of a rod-shaped element, the rod-shaped element forming the lever being bent into the shape of a bow. Achieved thereby, on the one hand, is a very simple manufacture of this foot-operated lever, and, on the other hand, the demands for an aesthetic appearance can be fulfilled, especially if a metal material is used whose surface can be improved by treatment. The end regions of the arms of the bow extend over the pivot axis, the arms of the lever, acting on the plate to push the plate away from the magnet, being held in the simplest way.

The end regions of the arms of the bow, which form the arms of the lever acting upon the plate, can be preferably bent toward each other, whereby the supporting surface is enlarged. Moreover a protective cap can be placed on each of the bent parts to deaden any possible noise which may arise when opening the drawer or pushing it into the furniture element.

A further preferred embodiment of the invention consists in providing two angle pieces, which are mounted, spaced apart from each other, on the floor of the furniture element, each angle piece being provided with a bearing in which the rod-shaped element is held between these two angle pieces. The foot-operated lever can thereby have a large width, which facilitates operation.

The plate is preferably mounted on the frame of the drawer, which is facilitated by the fact that the plate is provided with a bend which can be hung in a horizontally-running crosspiece of the frame, and by the fact that the plate can be screwed together with the front cover. With this bend, precise positioning, also for the plate, is achieved during assembly.

The spring element consists preferably of a tension spring, which is stretched out between two protrusions, which are fastened on a cross strut which holds the guide and which is anchored to the floor of the furniture piece. Provided on the frame of the drawer is a further cross strut, which is provided with a projection which runs into the stretched-out tension spring and stretches it when the drawer is pushed into the furniture element. With this design the advantage is achieved that in the pulled-out state of the drawer, the drawer is completely released from the spring, and it can be removed from the furniture element without it being necessary to release a spring first.

An embodiment of the invention will be described more closely in the following with reference to the attached drawing.

DETAILED DESCRIPTION OF THE PREFERRED EMBODIMENT

Figure 1:
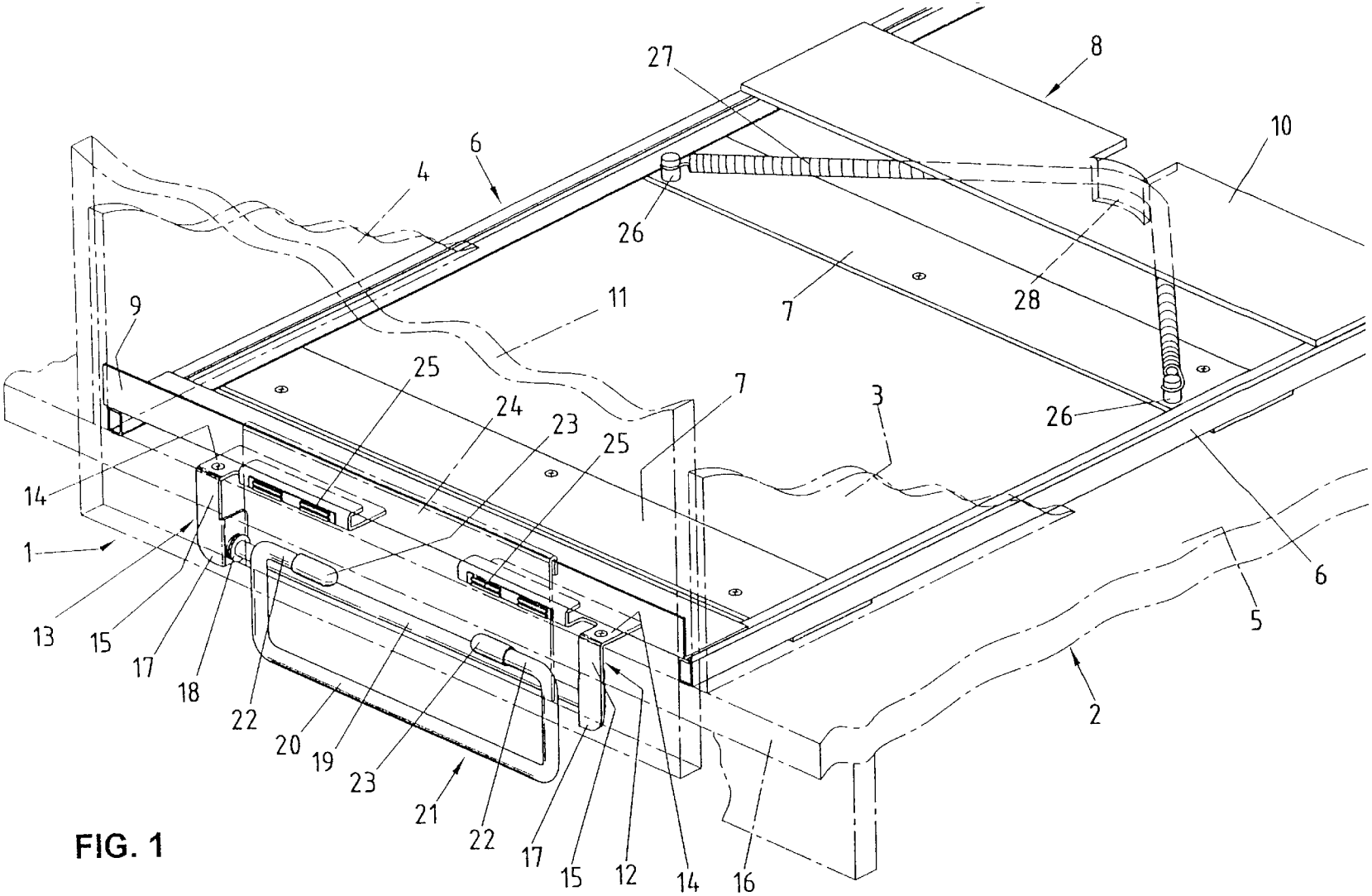
FIG. 1 shows in a spatial diagram the lower part of a furniture element with pushed-in drawer with the opening and closing mechanism according to the invention, certain parts having been depicted as transparent for reasons of visibility.

FIG. 1 shows the lower region of a drawer 1, which can be pulled out of, and pushed into, a furniture element 2. The furniture element 2, of which only parts of the side walls 3 and 4 and of the floor 5 have been indicated schematically in broken lines, is provided with two guides 6, disposed parallel, held on cross strut 7, which are fastened to the floor 5 of the furniture element. Held displaceably in these guides 6 is a frame 8 of the drawer 1 which is provided with corresponding guides. On the front side this frame 8 has a crosspiece 9, running horizontally, which has the shape of an angle element, while provided in the rear area is a further cross strut 10, which is connected to the guides of the drawer 1. A front cover 11 is placed on the front side of the frame 8 of the drawer 1.

Fastened to the floor 5 of the furniture element 2 are two angle pieces 12, 13. In each case an arm 14 of the respective angle piece 12 or 13 is screwed flat on the floor 5 of the furniture element 2. The other arm 15 of the respective angle piece 12 or 13 abuts the front face 16 of the floor 5, and has in each case a portion 17 projecting from the floor 5. On each of these projecting portions 17 is a bearing element 18, in which a rod-shaped element 19 is disposed. Fastened to this rod-shaped element 19 is a bow 20. The rod-shaped element 19 and the bow form a lever 21, which is pivotable and can be operated by foot, as will be described later on. Both the pivot axis 19 and the bow 20 are each formed by a rod-shaped element.

The end regions 22 of the bow 20 project above the pivot axis 19, are bent toward each other, and are each provided with a protective cap 23.

Inserted between the crosspiece 9 and the front cover 11 of the drawer 1 is a plate 24 made of a ferromagnetic material, as will be described later on. When the drawer 1 is pushed entirely into the furniture element 2, as is shown in FIG. 1, this plate 24 abuts magnets 25, which are fastened in each case in the angle pieces 12 and 13. The drawer 1 is kept in this pushed-in position by magnetic force.

Fastened to the rear cross strut 7, mounted on the floor 5 of the furniture element 2, are two protrusions 26, mounted on each end. Stretched between these two protrusions 26 is a tension spring 27. Provided on the further cross strut 10, which is mounted on the frame 8 of the drawer 1, is a projection 28 in which the tension spring 27 catches when the drawer 1 is pushed into the furniture element 2, so that the spring stretches out further until the drawer 1 is completely pushed in. When the drawer 1 is released, the tension spring 27 causes the drawer 1 to be brought by itself into the pulled-out position. In the forward part of the pull-out movement, the projection 28 is released. Upon pushing in of the drawer 1, this projection 28 automatically catches again in the tension spring 27.

Figure 2:
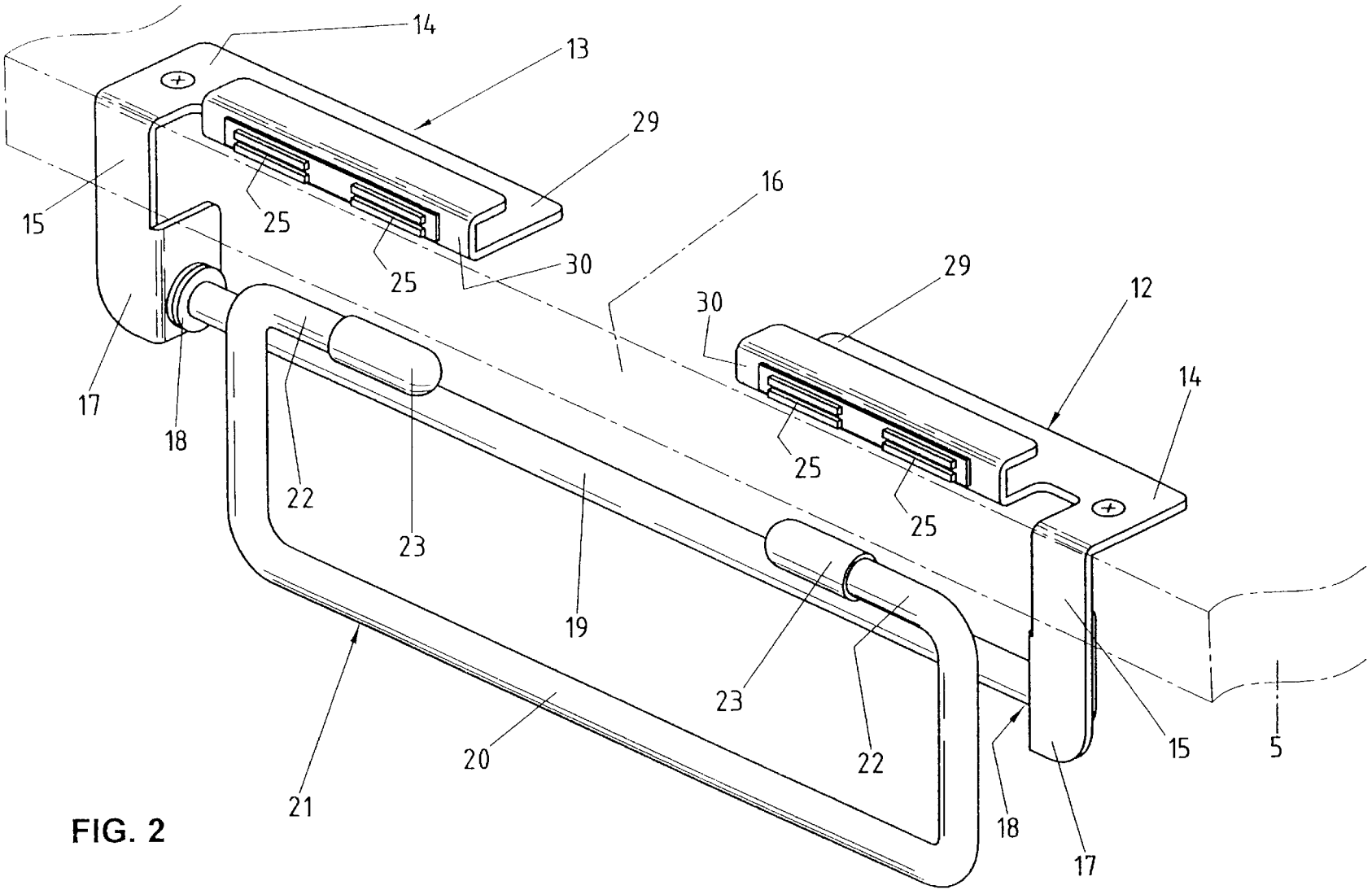
FIG. 2 shows in a spatial diagram the holding elements and the foot-operated lever in the state mounted on the floor of the furniture element.

FIG. 2 shows enlarged the floor 5 of the furniture element with the angle pieces 12 and 13 mounted thereon. As already mentioned, the one arm 14 of this angle piece 12 or 13, respectively, lies flat on the floor 5 and is screwed thereto. The other arm 15 of the angle piece 12 or 13, respectively, abuts the front face 16 of the floor 5. Thus during assembly of the angle pieces 12 and 13, each time this other arm 15 can serve as the stop face for precise positioning. Disposed on the portion 17, projecting from the floor 5, of the other arm 15 of the respective angle piece 12 or 13 is a bearing element 18, in which the rod-shaped element 19 of the lever 21 is held. Placed on the bent end regions 22 of the bow 20 are protective caps 23, as already mentioned, which can be made of an elastic, synthetic material, for example.

The two angle pieces 12 and 13 are each provided with a tab 29, which runs parallel to the floor 5 of the furniture element 2, and which has a bent portion 30, which runs parallel to the front face 16 of the floor 5 of the furniture element 2. The end of this bent portion 30 is bent again so that a U-shape receiving part is formed. The bent portion 30 is provided with a recess into which the magnet or magnets 25 is or are inserted. These magnets 25 are therefore also correctly positioned owing to the positioning of the angle pieces 12 and 13 with respect to the front face 16 of the floor 5 during assembly.

Figure 3:
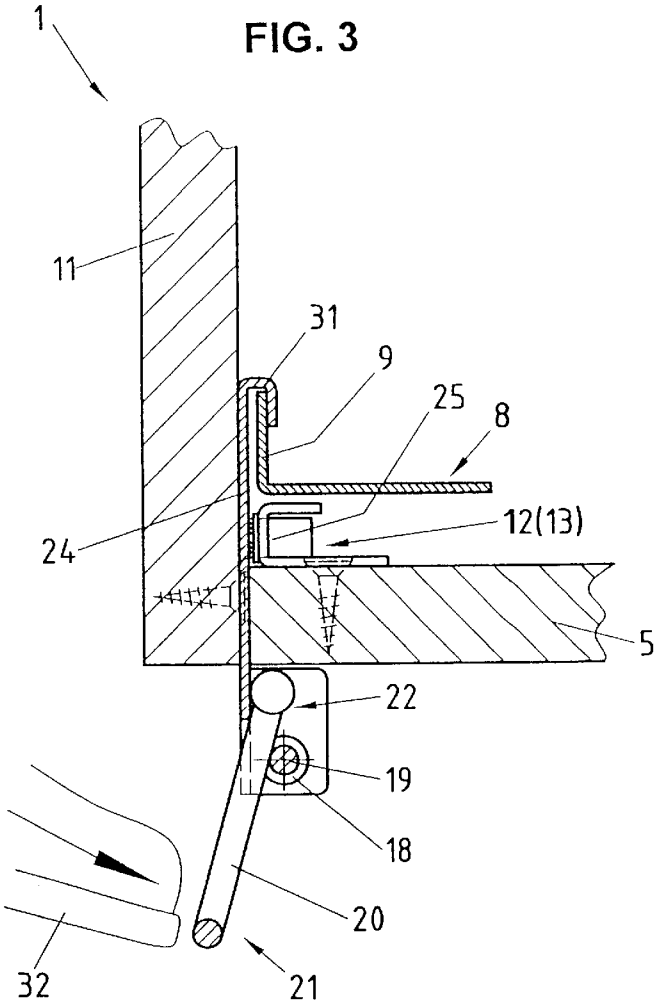
FIG. 3 is a vertical section through the part of the furniture element containting the opening and closing device, with the drawer pushed into the furniture element.
Figure 4:
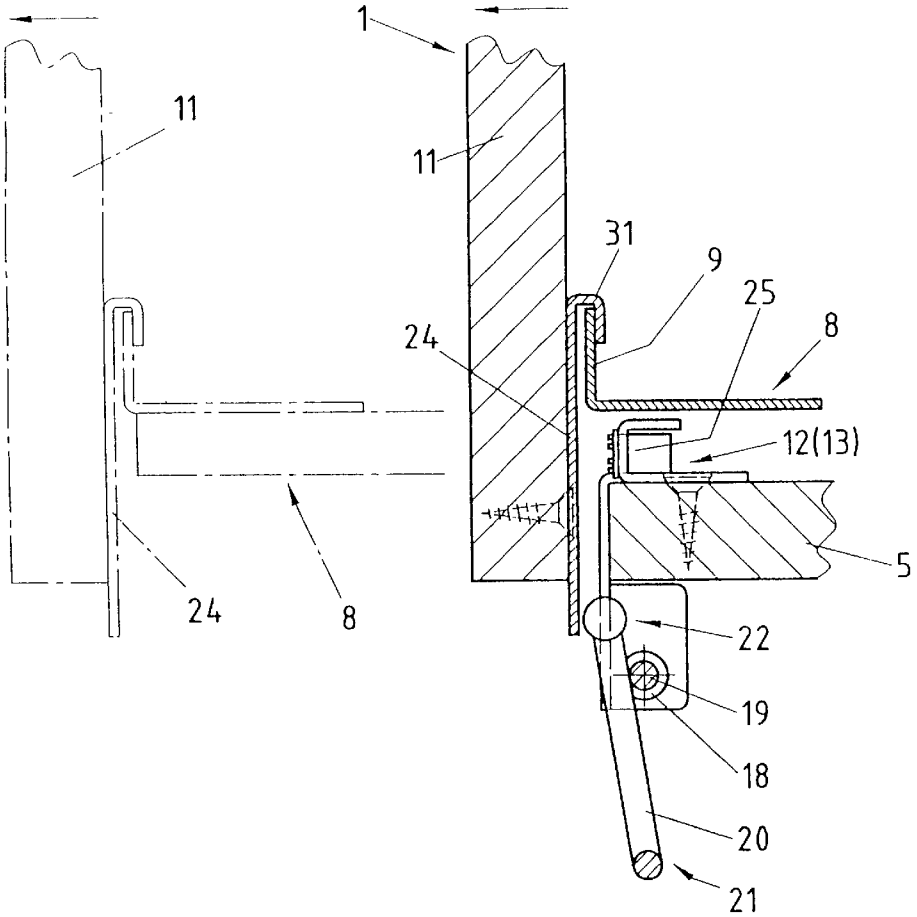
FIG. 4 is a section, corresponding to FIG. 3, of the device during opening the drawer, and, shown in broken lines, the pulled-out drawer.

As can be seen from FIGS. 3 and 4, the plate 24 is provided with a bend 31 so that, with this bend 31, it can be hung in the crosspiece 9 of the frame 8 of the drawer 1. The plate 24 is moreover screwed together with the front cover 11. Thus plate 24 is also precisely positioned.

Shown in FIG. 3 is the situation where the drawer 1 is located in the pushed-in position in the furniture element 2. The plate 24 abuts the magnets 25; it is held magnetically. The end regions 22 of the lever 21 lie behind the plate 24; the lever 21 is thereby placed inclined forwards. By foot, as indicated schematically by reference numeral 32, the lever 21 is pressed in the direction of the arrow, and, as shown in FIG. 3, is pivoted in the counterclockwise direction about the pivot axis 19. The end regions 22 thereby press upon the plate 24, causing said plate to be pushed away from the magnets 25; the magnetic connection is released. This situation is shown in FIG. 4. After the magnetic connection between magnets 25 and plate 24 has been released, the tension spring 27 (FIG. 1) causes the drawer 1 to be moved by itself into the pulled-out position, as is indicated by broken lines on the left side of FIG. 4. The lever hangs down freely.

Upon pushing the drawer 1 into the furniture element 2, the tension spring 27 is grasped by the projection 28, and is tensioned, as shown in FIG. 1. When it comes into the vicinity of the lever 21, the plate 24 pushes the lever back into the original position, as is shown in FIG. 3, the magnetic connection between magnet 25 and plate 24 is established, and the drawer is held in the pushed-in position.

As already mentioned, opening and closing mechanisms of this kind are used in particular for drawers used with a system for sorted disposal of garbage. Of course this device is not limited to drawers of this type, but instead is conceivable for any type of drawer.

With this opening and closing mechanism according to the invention for a drawer of a furniture element, a device has been created which is easy to mount since the positioning is given by the corresponding stops. Moreover the foot-operated lever is aesthetic, since it has simply the shape of a bow, and is easy to operate owing to the large width.

What is claimed is:

1. An opening and closing mechanism for use with a drawer, which, along guides, can be pulled out of, and pushed into, a furniture element formed by a floor, side walls and a cover, comprising:

a holding device, which comprises at least one angle piece having two arms, which device is adapted to fix to said floor in such a way that one of two said arms is adapted to lie flat against said floor of said furniture element, and the other of said two arms is adapted to abut the front face of the floor and has a portion projecting below the floor;

at least one bearing element provided on said other of said two arms, on the portion projecting below the floor;

at least one holding element provided on said holding device, in which holding element at least one magnet can be inserted;

a ferromagnetic plate, which is mountable on the drawer and which abuts the holding element in the state where the drawer is pushed into the furniture element;

a pivotable lever, held in said at least one bearing element so as to be pivotable about the pivot axis, and foot-operable, by means of which lever the plate can be released from the holding element; and a spring element which is adaptable to bring the drawer into the pulled-out position in the state where the holding element has been released from the plate.

2. The opening and closing mechanism of claim 1, wherein the pivot axis comprises a rod-shaped element, and the lever also comprises a rod-shaped element, which is bent substantially U-shaped and which forms a bow, which bow is connected to the rod-shaped element in such a way that the end regions of the arms of the bow extend above the pivot axis, and, by pivoting of the bow about the pivot axis toward the furniture element, are mountable against the plate mountable on the drawer.

3. The opening and closing mechanism of claim 2, wherein the end regions of the arms of the bow are bent toward each other, and in that a protective cap is placed on each of the bent parts.

4. The opening and closing mechanism of claim 3, wherein the rod-shaped element and the bow are made of a metallic material, and in that the surface is improved by treatment.

5. The opening and closing mechanism of claim 1, wherein the angle piece is provided with a tab which can run substantially parallel to the floor of the furniture element and which has a bent portion which can run parallel to the front face of the floor of the furniture element, and which is provided with a recess, in which a magnet is inserted and fastened.

6. The opening and closing mechanism of claim 1, wherein two angle pieces are provided, which are adapted to mount and spaced apart from each other on the floor of the furniture element.

7. The opening and closing mechanism of claim 1, wherein the plate is adapted to fasten to a frame forming the drawer, which can be provided with a front cover.

8. The opening and closing mechanism of claim 7, wherein the plate is provided with a bend, which is hung in a horizontally running crosspiece of the frame, which can run parallel to the front cover, and in that the plate is adapted to attach to the front cover.

9. The opening and closing mechanism of claim 1, wherein the spring element comprises a tension spring stretched out between two protrusions fixed to a cross strut, which cross strut holds guides and is anchorable to the floor of the furniture element, and a further cross strut is adapted for attachment to the frame, which further cross strut is provided with a projection, which runs into the tensioned tension spring, and stretches it, when the drawer is pushed into the furniture element.

* * * * *